US007887173B2

(12) United States Patent
Jones

(10) Patent No.: US 7,887,173 B2
(45) Date of Patent: Feb. 15, 2011

(54) TRANSPORT SYSTEM HAVING MULTIPLE MOVING FORCES FOR SOLID INK DELIVERY IN A PRINTER

(75) Inventor: Brent Rodney Jones, Sherwood, OR (US)

(73) Assignee: Xerox Corporation, Norwalk, CT (US)

( * ) Notice: Subject to any disclaimer, the term of this patent is extended or adjusted under 35 U.S.C. 154(b) by 446 days.

(21) Appl. No.: 12/016,675

(22) Filed: Jan. 18, 2008

(65) Prior Publication Data

US 2009/0185016 A1 Jul. 23, 2009

(51) Int. Cl.
*B41J 2/175* (2006.01)

(52) U.S. Cl. ..... 347/88; 347/99

(58) Field of Classification Search ..... 347/88, 347/99

See application file for complete search history.

(56) References Cited

U.S. PATENT DOCUMENTS 3,773,069 A * 11/1973 Rebentisch ..... 137/341
4,636,803 A * 1/1987 Mikalsen ..... 347/88
4,682,187 A * 7/1987 Martner ..... 347/88
5,123,961 A 6/1992 Yamamoto
5,181,049 A 1/1993 Mackay et al.
5,223,860 A 6/1993 Loofbourow et al.
5,276,468 A 1/1994 Deur et al.
5,341,164 A 8/1994 Miyazawa et al.
5,379,915 A 1/1995 Hudspeth et al.
5,386,224 A 1/1995 Deur et al.
5,442,387 A 8/1995 Loofbourow et al.
5,510,821 A 4/1996 Jones et al.
D371,157 S 6/1996 Chambers
D371,801 S 7/1996 Jones et al.

(Continued)

FOREIGN PATENT DOCUMENTS

EP 1359019 A1 11/2003

(Continued)

OTHER PUBLICATIONS

Non-Final Office Action for U.S. Appl. No. 11/602,938, Mailed Aug. 7, 2009, United States Patent and Trademark Office (10 pages).

(Continued)

*Primary Examiner*—Matthew Luu
*Assistant Examiner*—Rut Patel
(74) *Attorney, Agent, or Firm*—Maginot, Moore & Beck LLP

(57) ABSTRACT

A solid printer includes a solid ink transportation system that uses multiple forces to direct solid ink to a melting assembly within the printer. The solid ink transportation system includes a housing having an opening through which solid ink is inserted, a first transportation path coupled at one end to the housing opening and configured to operate as a gravity feed to move the solid ink from the housing opening along the first transportation path, at least one other transportation path coupled at one end to the other end of the first transportation path, the solid ink being moved along the at least one other transportation path primarily by a mechanically generated force, and a melting device coupled to an exit of the at least one other transportation path to receive the solid ink moved along the at least one other transportation path.

14 Claims, 7 Drawing Sheets

U.S. PATENT DOCUMENTS

| | | | | |
|---|---|---|---|---|
| D371,802 | S | 7/1996 | Jones et al. | |
| D372,268 | S | 7/1996 | Jones et al. | |
| D372,270 | S | 7/1996 | Jones et al. | |
| D373,139 | S | 8/1996 | Jones et al. | |
| D379,470 | S | 5/1997 | Gilbert | |
| D379,471 | S | 5/1997 | Gilbert | |
| D379,639 | S | 6/1997 | Gilbert | |
| D379,640 | S | 6/1997 | Gilbert | |
| D380,771 | S | 7/1997 | Jones | |
| D383,153 | S | 9/1997 | Jones et al. | |
| D383,154 | S | 9/1997 | Jones et al. | |
| 5,689,288 | A | 11/1997 | Wimmer et al. | |
| 5,734,402 | A | 3/1998 | Rousseau et al. | |
| 5,784,089 | A | 7/1998 | Crawford | |
| D402,308 | S | 12/1998 | Yao et al. | |
| D403,351 | S | 12/1998 | Yao et al. | |
| D403,352 | S | 12/1998 | Brown et al. | |
| D403,699 | S | 1/1999 | Chin et al. | |
| 5,861,903 | A | 1/1999 | Crawford et al. | |
| D407,109 | S | 3/1999 | Yao et al. | |
| D407,110 | S | 3/1999 | Yao et al. | |
| D407,111 | S | 3/1999 | Brown et al. | |
| D407,742 | S | 4/1999 | Yao et al. | |
| D407,743 | S | 4/1999 | Yao et al. | |
| D407,745 | S | 4/1999 | Brown et al. | |
| D408,849 | S | 4/1999 | Chin et al. | |
| D409,235 | S | 5/1999 | Chin et al. | |
| D409,237 | S | 5/1999 | Ellers et al. | |
| D410,026 | S | 5/1999 | Brown et al. | |
| D410,490 | S | 6/1999 | Mattern et al. | |
| 5,917,528 | A * | 6/1999 | Grellmann et al. | 347/88 |
| D412,527 | S | 8/1999 | Ellers et al. | |
| D412,528 | S | 8/1999 | Ellers et al. | |
| D412,934 | S | 8/1999 | Jones | |
| D413,625 | S | 9/1999 | Brown et al. | |
| D414,200 | S | 9/1999 | Jones | |
| D415,193 | S | 10/1999 | Jones | |
| D416,936 | S | 11/1999 | Chin et al. | |
| 5,975,690 | A * | 11/1999 | Grellmann et al. | 347/88 |
| 5,988,805 | A | 11/1999 | Meinhardt | |
| 6,053,608 | A | 4/2000 | Ishii et al. | |
| 6,056,394 | A | 5/2000 | Rousseau et al. | |
| 6,109,803 | A | 8/2000 | Yasui et al. | |
| D436,124 | S | 1/2001 | Mattern et al. | |
| D436,989 | S | 1/2001 | Mattern et al. | |
| 6,170,942 | B1 * | 1/2001 | Ogawa et al. | 347/88 |
| D440,248 | S | 4/2001 | Mattern et al. | |
| D440,249 | S | 4/2001 | Ellers et al. | |
| D453,786 | S | 2/2002 | Mattern | |
| D453,787 | S | 2/2002 | Mattern | |
| 6,422,694 | B1 | 7/2002 | Hollands | |
| 6,543,867 | B1 | 4/2003 | Jones | |
| 6,561,636 | B1 | 5/2003 | Jones | |
| 6,565,200 | B1 | 5/2003 | Jones | |
| 6,565,201 | B1 | 5/2003 | Jones | |
| 6,572,225 | B1 | 6/2003 | Jones | |
| D478,347 | S | 8/2003 | Jones | |
| D478,621 | S | 8/2003 | Jones | |
| D479,368 | S | 9/2003 | Jones | |
| D481,757 | S | 11/2003 | Jones | |
| D481,758 | S | 11/2003 | Jones | |
| D481,759 | S | 11/2003 | Jones et al. | |
| D482,062 | S | 11/2003 | Jones | |
| D482,063 | S | 11/2003 | Jones et al. | |
| D482,388 | S | 11/2003 | Jones | |
| D482,389 | S | 11/2003 | Jones | |
| D482,720 | S | 11/2003 | Jones et al. | |
| D482,721 | S | 11/2003 | Jones | |
| D482,722 | S | 11/2003 | Jones | |
| 6,648,435 | B1 | 11/2003 | Jones | |
| D483,062 | S | 12/2003 | Jones | |
| D483,063 | S | 12/2003 | Jones | |
| D483,404 | S | 12/2003 | Jones et al. | |
| 6,672,716 | B2 | 1/2004 | Jones | |
| 6,679,591 | B2 | 1/2004 | Jones | |
| 6,705,710 | B2 | 3/2004 | Jones et al. | |
| 6,709,094 | B2 | 3/2004 | Jones | |
| 6,719,413 | B2 | 4/2004 | Jones | |
| 6,719,419 | B2 | 4/2004 | Jones et al. | |
| 6,722,764 | B2 | 4/2004 | Jones et al. | |
| 6,739,713 | B2 | 5/2004 | Jones et al. | |
| 6,746,113 | B1 | 6/2004 | Leighton et al. | |
| 6,755,517 | B2 | 6/2004 | Jones et al. | |
| 6,761,443 | B2 | 7/2004 | Jones | |
| 6,761,444 | B2 | 7/2004 | Jones et al. | |
| 6,824,241 | B2 | 11/2004 | Sonnichsen et al. | |
| D500,784 | S | 1/2005 | Jones et al. | |
| D500,785 | S | 1/2005 | Jones et al. | |
| 6,840,612 | B2 | 1/2005 | Jones et al. | |
| 6,840,613 | B2 | 1/2005 | Jones | |
| 6,857,732 | B2 | 2/2005 | Jones et al. | |
| 6,866,375 | B2 | 3/2005 | Leighton et al. | |
| 6,874,880 | B2 | 4/2005 | Jones | |
| 6,893,121 | B2 | 5/2005 | Jones | |
| 6,895,191 | B2 | 5/2005 | Rommelmann et al. | |
| D505,974 | S | 6/2005 | Jones et al. | |
| 6,905,201 | B2 | 6/2005 | Leighton | |
| 6,929,360 | B2 | 8/2005 | Jones | |
| 6,966,644 | B2 | 11/2005 | Jones et al. | |
| 6,981,754 | B2 | 1/2006 | Godil et al. | |
| 6,986,570 | B2 | 1/2006 | Jones et al. | |
| 7,063,412 | B2 | 6/2006 | Jones et al. | |
| 7,066,589 | B2 | 6/2006 | Jones et al. | |
| D524,370 | S | 7/2006 | Jones et al. | |
| 7,104,635 | B2 | 9/2006 | Jones | |
| D531,210 | S | 10/2006 | Jones | |
| D533,900 | S | 12/2006 | Jones et al. | |
| D535,327 | S | 1/2007 | Korn et al. | |
| D535,689 | S | 1/2007 | Jones et al. | |
| D537,116 | S | 2/2007 | Jones et al. | |
| 2003/0202066 | A1 | 10/2003 | Jones | |
| 2003/0202067 | A1 | 10/2003 | Jones et al. | |
| 2003/0202069 | A1 | 10/2003 | Jones | |
| 2003/0202070 | A1 | 10/2003 | Jones | |
| 2003/0202071 | A1 | 10/2003 | Jones et al. | |
| 2003/0202074 | A1 | 10/2003 | Jones | |
| 2003/0202075 | A1 | 10/2003 | Jones | |
| 2003/0202077 | A1 | 10/2003 | Jones et al. | |
| 2003/0222930 | A1 | 12/2003 | Jones | |
| 2003/0222951 | A1 | 12/2003 | Jones | |
| 2003/0222952 | A1 | 12/2003 | Jones | |
| 2003/0222953 | A1 | 12/2003 | Jones | |
| 2003/0222954 | A1 | 12/2003 | Jones et al. | |
| 2003/0222955 | A1 | 12/2003 | Jones | |
| 2004/0160498 | A1 | 8/2004 | Jones | |
| 2004/0179074 | A1 | 9/2004 | Jones et al. | |
| 2004/0183875 | A1 | 9/2004 | Jones et al. | |
| 2005/0007428 | A1 | 1/2005 | Joppen | |
| 2005/0063820 | A1 | 3/2005 | Awdalla | |
| 2005/0146584 | A1 | 7/2005 | Godil et al. | |
| 2005/0151814 | A1 | 7/2005 | Wong et al. | |
| 2006/0227193 | A1 * | 10/2006 | Leighton | 347/99 |
| 2007/0153068 | A1 | 7/2007 | Jones et al. | |
| 2008/0117264 | A1 | 5/2008 | Fairchild et al. | |
| 2008/0117265 | A1 | 5/2008 | Esplin et al. | |
| 2008/0117266 | A1 | 5/2008 | Esplin et al. | |
| 2008/0117267 | A1 | 5/2008 | Fairchild et al. | |
| 2008/0122907 | A1 | 5/2008 | Jones | |
| 2008/0136881 | A1 | 6/2008 | Fairchild et al. | |
| 2008/0136882 | A1 | 6/2008 | Fairchild et al. | |

2008/0218572 A1 9/2008 Fairchild et al.

FOREIGN PATENT DOCUMENTS

JP 11115213 A * 4/1999

OTHER PUBLICATIONS

Amendment in Response to Non-Final Office Action for U.S. Appl. No. 11/602,938, submitted Sep. 2, 2009 (29 pages).
Non-Final Office Action for U.S. Appl. No. 11/602,937, Mailed Sep. 21, 2009, United States Patent and Trademark Office (7 pages).
Amendment in Response to Non-Final Office Action for U.S. Appl. No. 11/602,937, submitted Dec. 21, 2009 (8 pages).
Final Office Action for U.S. Appl. No. 11/602,937, Mailed Apr. 14, 2010, United States Patent and Trademark Office (8 pages).
Amendment accompanying a Request for Continued Examination for U.S. Appl. No. 11/602,937, submitted Apr. 23, 2010 (9 pages).
Non-Final Office Action for U.S. Appl. No. 11/602,931, Mailed Jun. 9, 2009, United States Patent and Trademark Office (21 pages).
Amendment in Response to Non-Final Office Action for U.S. Appl. No. 11/602,931, submitted Sep. 8, 2009 (17 pages).
Final Office Action for U.S. Appl. No. 11/602,931, Mailed Jan. 5, 2010, United States Patent and Trademark Office (21 pages).
Amendment accompanying a Request for Continued Examination for U.S. Appl. No. 11/602,931, submitted Apr. 5, 2010 (9 pages).
Second Non-Final Office Action for U.S. Appl. No. 11/602,931, Mailed Jun. 22, 2010, United States Patent and Trademark Office (9 pages).
Non-Final Office Action for U.S. Appl. No. 11/602,710, Mailed Aug. 11, 2009, United States Patent and Trademark Office (7 pages).
Amendment in Response to Non-Final Office Action for U.S. Appl. No. 11/602,710, submitted Nov. 12, 2009 (13 pages).
Final Office Action for U.S. Appl. No. 11/602,710, Mailed Mar. 5, 2010, United States Patent and Trademark Office (7 pages).
Amendment accompanying a Request for Continued Examination for U.S. Appl. No. 11/602,710, submitted Apr. 23, 2010 (5 pages).
Second Non-Final Office Action for U.S. Appl. No. 11/602,710, Mailed May 13, 2010, United States Patent and Trademark Office (8 pages).

* cited by examiner

TRANSPORT SYSTEM HAVING MULTIPLE MOVING FORCES FOR SOLID INK DELIVERY IN A PRINTER

CROSS-REFERENCE TO RELATED APPLICATIONS

Cross reference is made to the following applications: U.S. Ser. No. 11/602,931 entitled "Printer Solid Ink Transport and Method," which was filed on Nov. 21, 2006, U.S. Ser. No. 11/602,937 entitled "Guide For Printer Solid Ink Transport and Method," which was filed on Nov. 21, 2006, U.S. Ser. No. 11/602,710 entitled "Solid Ink Block Features for Printer Ink Transport and Method," which was filed on Nov. 21, 2006, and U.S. Ser. No. 11/602,938 entitled "Transport System for Solid Ink for Cooperation with Melt Head in a Printer," which was filed on Nov. 21, 2006, all of which are owned by the assignee of the subject matter described below and all of which are expressly incorporated herein by reference.

TECHNICAL FIELD

The transport system disclosed below generally relates to solid ink printers, and, more particularly, to solid ink printers that move solid ink units in three spatial dimensions.

BACKGROUND

Solid ink or phase change ink imaging devices, hereafter called solid ink printers for convenience, encompass various imaging devices, such as printers and multi-function devices. These printers offer many advantages over other types of image generating devices, such as laser and aqueous inkjet imaging devices. Solid ink or phase change ink printers conventionally receive ink in a solid form, either as pellets or as ink sticks. A color printer typically uses four colors of ink (yellow, cyan, magenta, and black).

The solid ink pellets or ink sticks, hereafter referred to as ink, sticks, or ink sticks, are delivered to a melting device, which is typically coupled to an ink loader, for conversion of the solid ink to a liquid. A typical ink loader typically includes multiple feed channels, one for each color of ink used in the imaging device. The ink for a particular color is placed in an insertion opening in the feed channel and then either gravity fed or urged by a conveyor or spring loaded pusher along the feed channel toward the melting device. The melting device heats the solid ink impinging on it and melts it into a liquid for delivery to a print head for jetting onto a recording medium or intermediate transfer surface.

The feed channel insertion openings may be covered by a key plate with a keyed opening for each feed channel. The keyed openings help ensure a printer user places the correct sticks into a feed channel. Each keyed opening of the key plate has a unique shape. The ink sticks of the color for that feed channel have a shape corresponding to the shape of the keyed opening. The keyed openings and corresponding stick shapes exclude from each ink feed channel sticks of all colors except the ink sticks of the proper color for that feed channel. Unique keying shapes for other factors are also being employed to exclude sticks from being inserted that are not correctly formulated or intended for different printer models.

Solid ink printers significantly differ from ink cartridge or toner printers because they need not be exhausted before additional solid ink is added to the feed channel. Specifically, ink cartridges and toner cartridges should be exhausted before another cartridge is installed so as not to waste ink or toner in a partially emptied cartridge. These cartridges may be typically returned to the manufacturer or other source to be refilled. Solid ink, on the other hand, may be stored on the premises and installed a stick at a time or as a group of pellets. Because the entire solid ink unit is consumed in the printing process, no housing or other component survives for disposal or return to the manufacturer.

The requirement that the ink sticks remain solid until they impinge upon the melting assembly does present some challenges not present in ink cartridge and toner cartridge printers. Because the ink loader is above the ambient room temperature, the ink softens. The softened ink requires more force to be applied to the ink to overcome the increased friction. Additionally, a limit exists for the temperature level in an ink loader in order to prevent the ink from becoming too soft and losing its shape in the loader.

The components of a solid ink printer must be arranged to perform the functions of transporting the solid ink to a melting assembly, providing the molten ink to one or more print heads for ejection onto an image receiving member, affixing the ink image to media, and delivering the media bearing the image to an output tray. The requirements of these functions affect the geometry of the printer, the arrangement of the components, and the size of the printer. Consequently, the various subsystems of a solid ink printer compete for placement and location within a printer. Therefore, solid ink transport methods that enable more flexibility in routing and arrangement would facilitate the overall design of solid ink printers.

SUMMARY

The limitations on the routing and arrangement of components for transporting solid ink with a loader to a melting device have been addressed by a transport system that incorporates multiple motive forces for moving solid ink along the feed paths. The transport system includes a housing having an opening through which solid ink is inserted, a first transportation path coupled at one end to the housing opening, the solid ink being moved from the housing opening along the first transportation path primarily by gravity, at least one other transportation path coupled at one end to the other end of the first transportation path, the solid ink being moved along the at least one other transportation path primarily by a mechanically generated force, and a melting device coupled to an exit of the at least one other transportation path to receive the solid ink moved along the at least one other transportation path.

Another embodiment of a solid ink transport system incorporates a conveyor in at least one of the transportation paths. The system includes a housing having an opening through which solid ink is inserted, a first transportation path coupled at one end to the opening, the solid ink being moved from the opening along the first transportation path primarily by gravity, at least one other transportation path coupled at one end to another end of the first transportation path, the at least one other transportation path having a conveyor that is coupled at one end to an electrical motor to move the conveyor and transport solid ink along the one other transportation path towards an exit, a melting device coupled to the exit to receive the solid ink moved by the conveyor along the second transportation path.

BRIEF DESCRIPTION OF THE DRAWINGS

Features for transporting solid ink in a solid ink printer are discussed with reference to the drawings, in which.

DETAILED DESCRIPTION

The term "printer" refers, for example, to reproduction devices in general, such as printers, facsimile machines, copiers, and related multi-function products. While the specification focuses on a system that transports solid ink through a solid ink printer, the transport system may be used with any solid ink image generating device.

Figure 1:
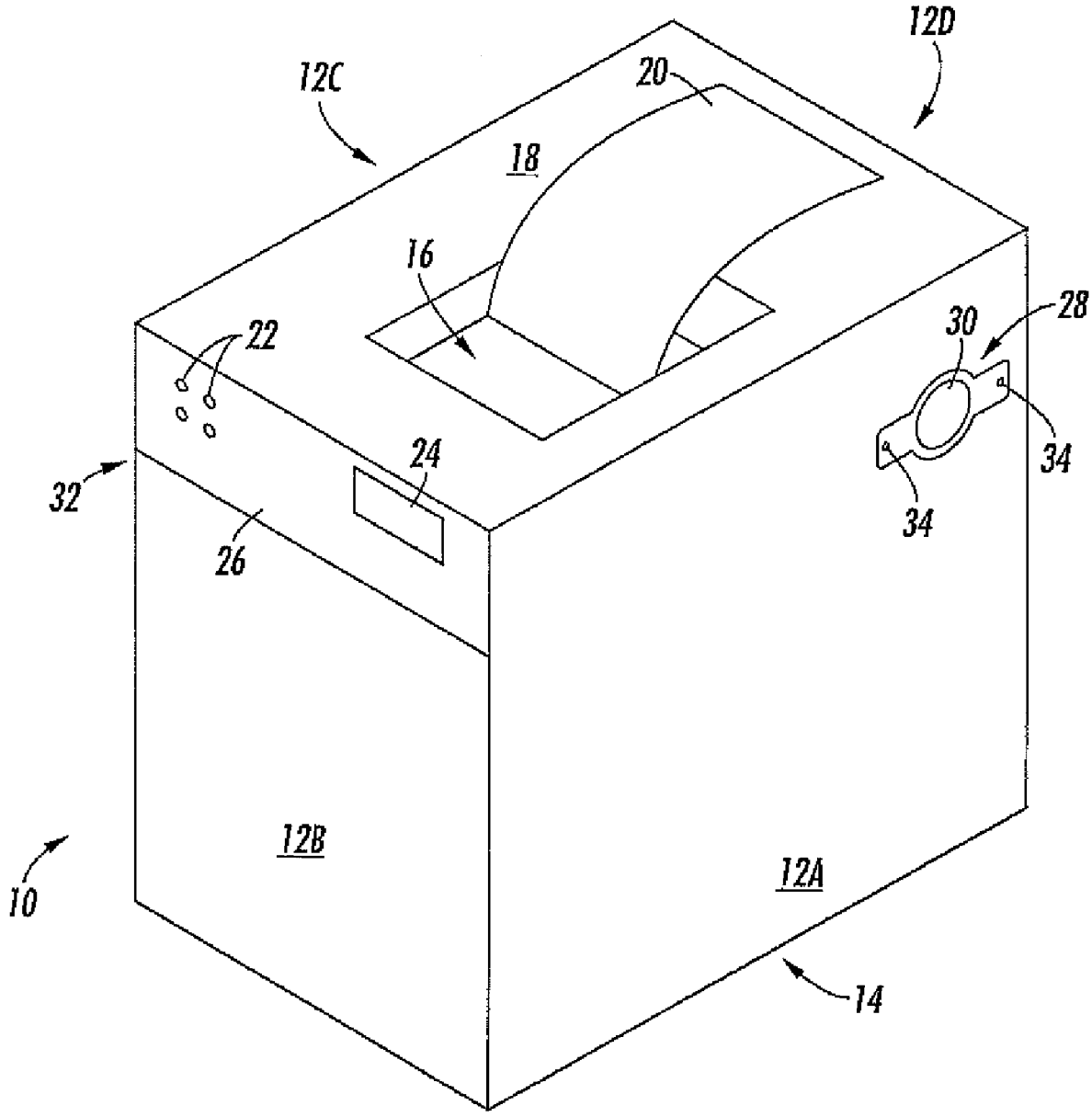
FIG. 1 is a perspective view of a solid ink printer incorporating the transport system shown in FIG. 2.

An exemplary solid ink printer having a solid ink transport system described in this document is shown in FIG. 1. The printer 10 includes a housing 32 having four vertically standing side walls 12A, 12B, 12C, and 12D, a bottom surface 14, and a top surface 18. Although the printer 10 is depicted in a shape that may be described as a rectangular solid, other shapes are possible. Additionally, the surfaces of the housing need not be planar and may include depressions and/or protrusions to accommodate internal components or enhance the visibility of external features. The housing may also include a control panel 26 having a display 24 and one or more function keys 22 or other control actuators or indicators.

The upper surface 18 of the housing 32 may include, for example, an output tray 16. Recording media, such as a paper sheet 20, exit the housing 32 and rest in the output tray 16 until retrieved by a user or operator. The housing 32 may include a media supply tray (not shown) from which recording media may be removed and processed by the printer 10. While the output tray 16 is shown as being in the upper surface 18 of the housing 32, other positions are possible, such as extending from rear wall 12D or one of the other side walls.

Figure 2:
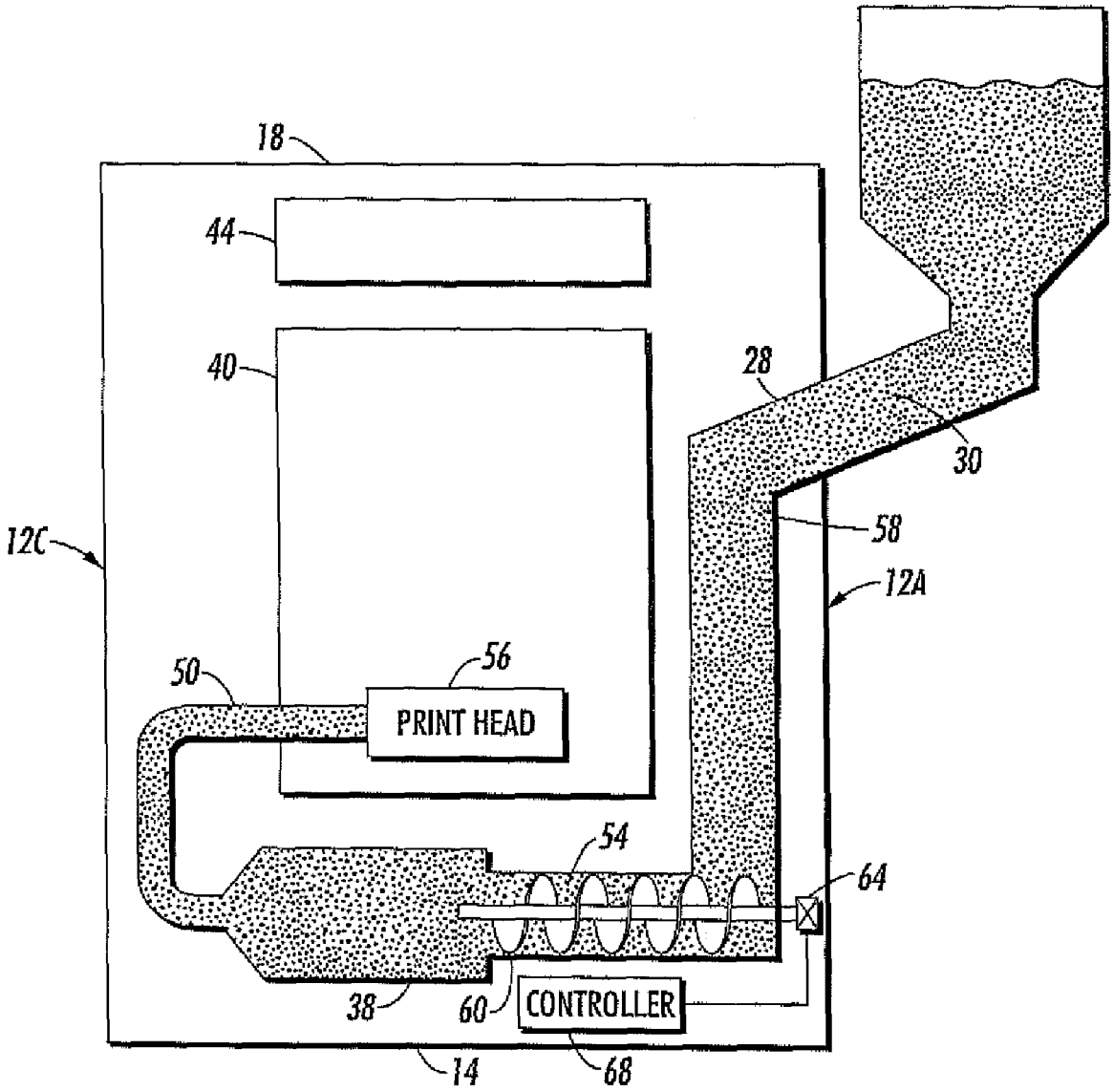
FIG. 2 is a cross-sectional view of the opening for a loader that may be used in the printer shown in FIG. 1.

As shown in FIG. 1, a loader 28 includes an opening 30 in the housing 32. Although the opening is depicted as being in the side wall 12A, it may be located in one of the other side walls or in the upper surface 18. The opening 30 may be surrounded by a mechanical coupler 34 for mating with a container of solid ink (FIG. 2). The mechanical coupler 34 may be, for example, a bayonet fitting, a threaded opening, a quick connect fitting, or the like. In another embodiment, the housing 32 may include a hinged cover that may be opened to expose the loader 28 and a repository into which a container of solid ink may be mounted or into which the contents of a container of solid ink may be placed. A container may be a stacker, accumulator, feed channel, or any ink storage configuration. While the loader is shown in side wall 12A, it may be incorporated in one of the other surfaces, such as end walls or in the upper surface 18 of the housing 32.

As shown in FIG. 2, an exemplary transport system includes a loader 28, a first transportation path 58, a second transportation path 60, and a melting assembly 38. The loader 28 includes an opening 30 through which solid ink is inserted for use in the printer 10. The solid ink may be in small pieces, pastille or granular form and stored in a container, such as the vessel shown in FIG. 2. In another embodiment, the loader 28 may be configured to accept rectangular solid or cubic shaped ink sticks as well as spherical, cylindrical, or other shaped ink sticks or small pieces of ink.

The first transportation path 58 is coupled at one end to the loader 28 and at the other end to the second transportation path 60. The first transportation path 58 may be configured as a tube, which can be of any functional cross sectional shape, or a trough, for example, to contain the solid ink as it moves along the first transportation path 58. While these types of transportation paths may be advantageous for granules or pastille form, a ramp or channel may be better suited for blocks, such as rectangular solids or cylindrical solids. Small pieces of ink in any of various forms may be able to utilize either type of transportation path. As shown in FIG. 2, the first transportation path 58 is oriented so it has a vertical drop. This vertical drop may be at an angle with respect to the bottom surface 14 or it may be essentially a straight drop towards the bottom surface. The vertical drop helps ensure that gravity is the primary or most significant influencing force that moves the solid ink from the loader 28 to the second transportation path 60.

All of the vertical angles depicted in the figures are shown as having a slope of approximately ninety degrees, however, these vertical paths may be lesser grades. Any path angle that enables gravity to move the solid ink in the intended direction with or without the input of other augmenting motive forces, such as vibration or air flow, is encompassed for these paths. Solid ink in either a particulate form or block form has a tendency to stick to itself or adjacent surfaces. Subtle motions, vibrations, air flow, pulsed air blasts, and other motive forces that can continue or restore movement to solid ink along a path are contemplated as ancillary aspects of a gravity feed system. In such a system, implementation of these supplemental movement forces would be insufficient to move the ink reliably in the absence of gravity. Gravity feed as used herein refers to a force that moves solid ink with gravity alone or that uses gravity to augment another motive force acting on the solid ink or that enables another motive force to move solid ink along a path.

The second transportation path 60 is coupled to the first transportation path 58 at one end and to the melting assembly 38 at the other end. The first transportation path 58 may be coupled to the second transportation path 60 with a mechanical fitting, male/female mating connectors, or by sliding the terminating end of the first transportation path through an orifice in the second transportation path 60. Although the second transportation path 60 may be oriented so gravity assists with the movement of the solid ink along the second transportation path, the primary force that moves solid ink along the second transportation path 60 is generated by an electromechanical force. Consequently, the second transportation path may be practically horizontal with respect to the bottom surface 14. Although only a single additional transportation path, namely, path 60, is shown in FIG. 2, other additional paths may be provided for delivering the solid ink to the melting device. Each additional path has two ends, one of which is coupled to the preceding path and the other of which is coupled to an end of the next path. The last or final path terminates in an exit from which the solid ink is transitioned to the melting device for the generation of liquid ink.

In the printer shown in FIG. 2, the solid ink is supplied from the second transportation path 60 to the melting assembly 38. The melting assembly 38 receives the solid ink and melts it as required, based on printer operation and determined by a controller (not shown). The melted ink is provided by an umbilical tube 50 or other conduit to a print head 56. The print head 56 is operated by a print head controller (not shown) to eject the melted ink onto a rotating image receiving member 40, such as a print drum. A transfix roller 44 is mounted near the print drum 40 and is movable so it can form a nip with the print drum 40. As the nip between the print drum 40 and the transfix roller 44 forms, a sheet of recording medium is fed into the nip and synchronized so the image formed on the print drum 40 is transferred to the recording medium as it passes through the nip. The sheet with the image is then directed to the output tray 16.

The melting assembly 38 may include a seal at the end coupled to the final transportation path 60. The force moving the solid ink along the second transportation path 60 urges the solid ink through the seal. The seal helps pressurize the melted ink within the melting assembly. This pressure may be used to push the melted ink through the tube to the print head. Alternatively, melted ink may be dripped directly from the melt device into a receiving reservoir or it may flow or be conveyed through a non-pressurized channel.

In another embodiment, the first transportation path 58 is a gravity induced drop from the loader 28 to the second transportation path 60. The second transportation path is coupled at one end to the first transportation path and is coupled at its other end to a third transportation path. The third transportation path 50 extends from the second transportation path into the interior of the housing 32. The third transportation path may utilize gravity, vibration, or other motive means to transport the ink to a melt station or reservoir.

In the embodiment shown in FIG. 2, a motor 64 is coupled to a helical device, such as an auger 54, to propel the solid ink along the second transportation path 60, although other driven conveyors may be used. The motor 64 is operated by a controller 68, which may be the controller for the printer or a controller associated with the transport system. The controller may be a general purpose processor and associated memory in which programmed instructions are stored. Execution of the programmed instructions enables the controller to operate the motor at an appropriate speed. The motor 64 may be any similar driver device, such as a bi-directional motor, motor driven reciprocator, solenoid, or the like and the controller may generate a signal that determines the direction of the driver's rotation or actuation. The controller may, alternatively, be an application specific integrated circuit or a group of electronic components configured on a printed circuit for operation of the motor 64. Thus, the controller may be implemented in hardware alone, software alone, or a combination of hardware and software. One or more sensors along the feed and/or melt path (not shown) may be employed to monitor movement of the conveyor or the solid ink carried by the conveyor and enable the controller to operate the conveyor more precisely.

Figure 3:
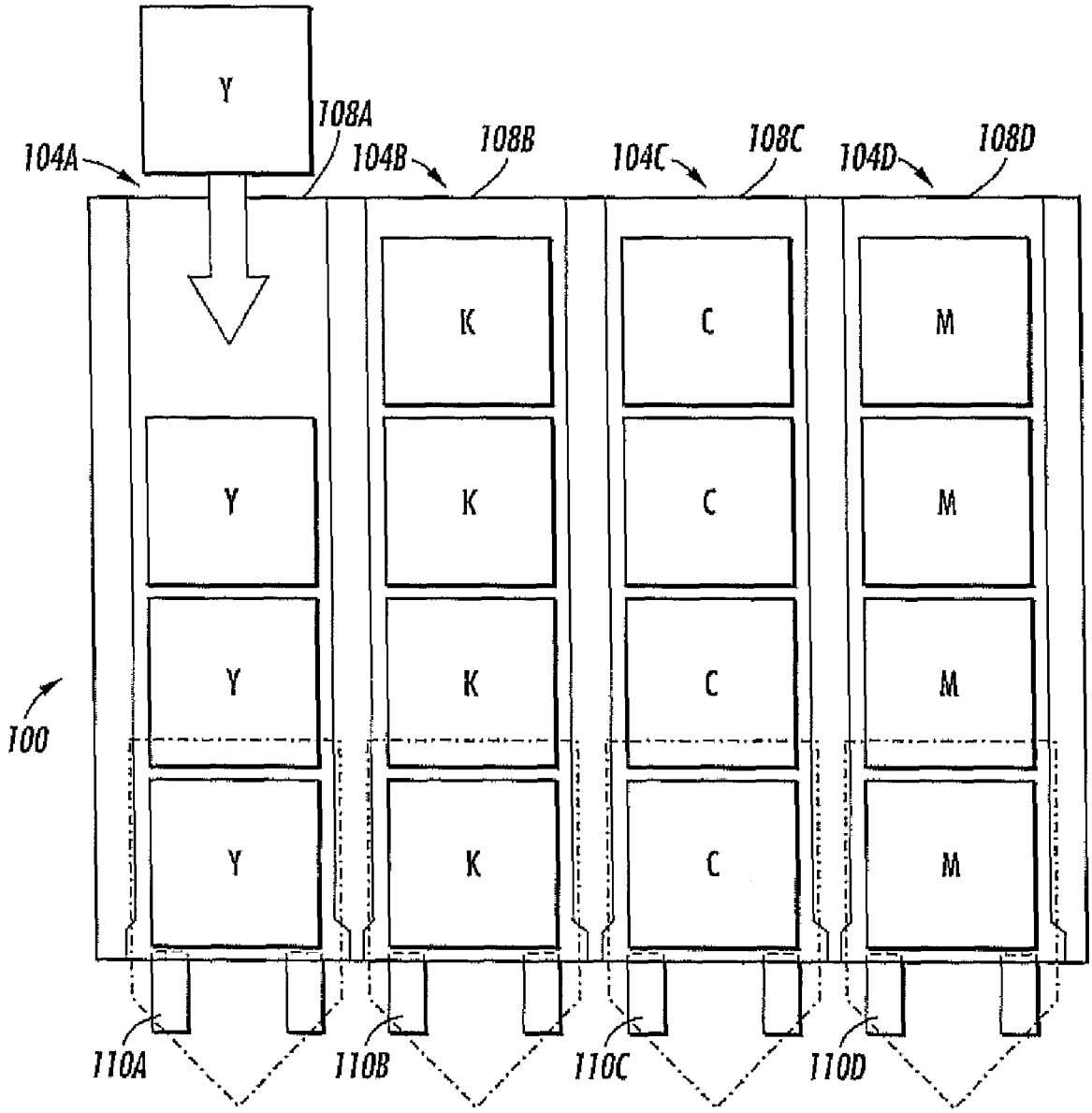
FIG. 3 is a front view of a gravity fed loader having a mechanized feed for delivery of solid ink to a melting assembly.
Figure 4:
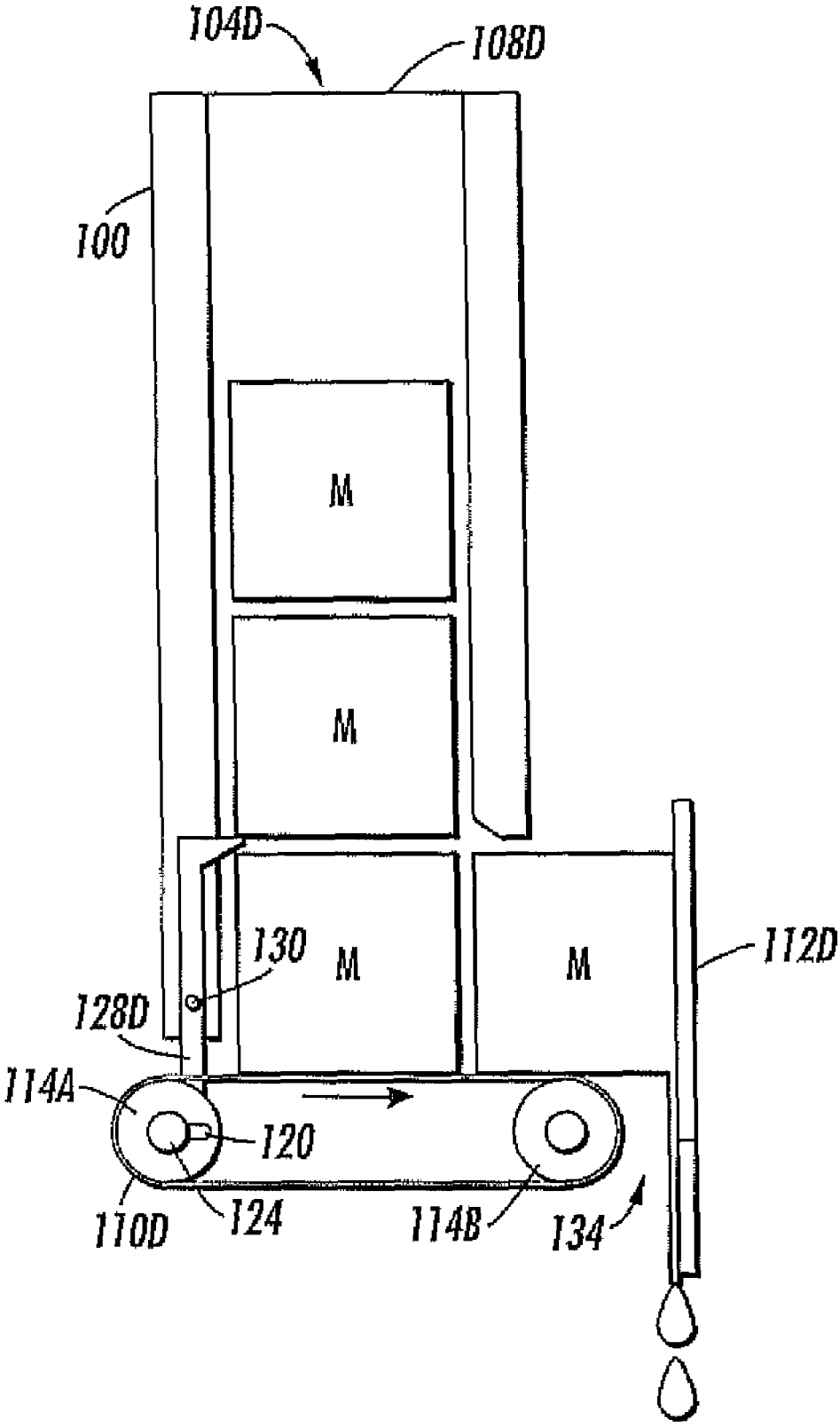
FIG. 4 is a side view of the loader shown in FIG. 3.

In another embodiment, the second transportation path 60 may be a mechanized conveyor, such as an endless belt, one or more rollers, a helical urger, or a walking beam, in which the ink form rests upon or is pushed against the conveyer. Endless belt as used herein includes all similar types of conveyances, including those that use chain, mesh material, and the like. An endless belt embodiment is shown in FIG. 3 and FIG. 4. The ink loader in this embodiment is a gravity fed loader 100 that includes four feed channels 104A, 104B, 104C, and 104D. Each feed channel has an opening 108A, 108B, 108C, and 108D, respectively, at one end and a conveyor belt 110A, 110B, 110C, and 110D, respectively, at the other end. Ink sticks are dropped through the opening of each feed channel until the ink stick comes to a stop on the conveyor belt or another ink stick in the feed channel.

A side view of the loader 100 is shown in FIG. 4. Located near the end of each conveyor that is outboard from the insertion feed channel, is a melt assembly 112 for melting the solid ink and collecting it in a reservoir (not shown). This structure is depicted in FIG. 4 with reference to feed channel 104D and conveyor 110D. The conveyor 110D also includes drive wheels or sprockets 114A and 114B that rotate the endless belt 110D. Mounted to the shaft 124 about which sprocket 114A is mounted is a mechanical actuator 120. As the sprocket 114A rotates in a clockwise manner to move the ink stick on the conveyor belt 110D from the feed channel 104D to the melt assembly 112D, the mechanical actuator rotates to a position in which it engages gate arm 128D. As the sprocket 114A continues to rotate, it pivots gate arm 128D about pin 130 to enable the next ink stick to continue its descent to the conveyor 110D as the ink stick on the conveyor is moved towards the melt assembly 112D. The outboard end of the conveyor belt 110D is separated from the melt assembly 112D by a gap 134 to reduce the exposure of the conveyor belt to the heat generated by the melt assembly and the melted ink as it flows down the melt assembly. Although the conveyor belt 110D is shown as being long enough to push two ink sticks, the belt may be shorter or longer, as appropriate for the operational requirements and geometry of the printer.

Figure 5:
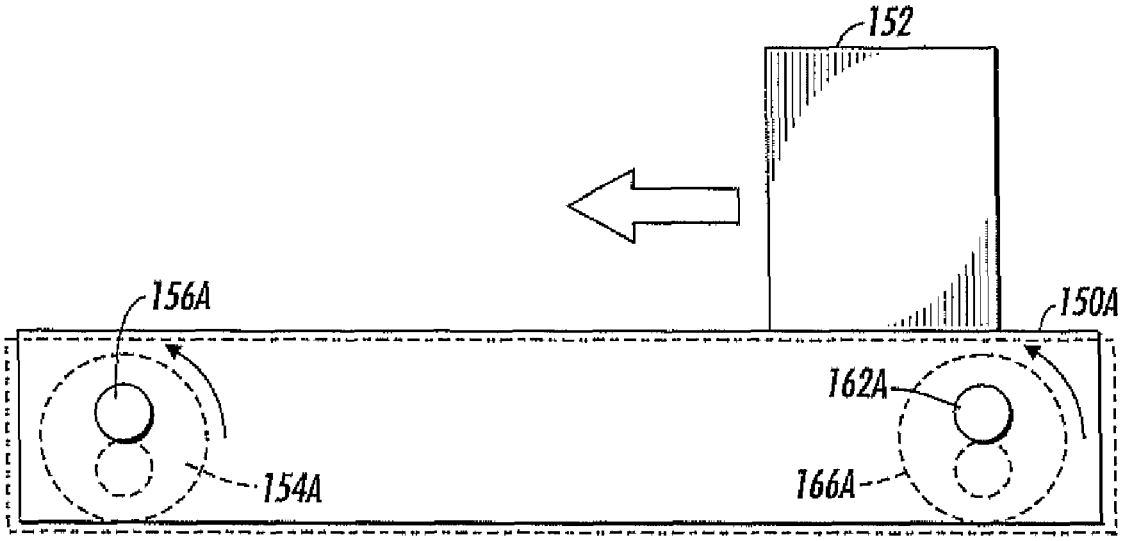
FIG. 5 is a side view of a walking beam that may be used to deliver solid ink to a melting assembly.
Figure 6:
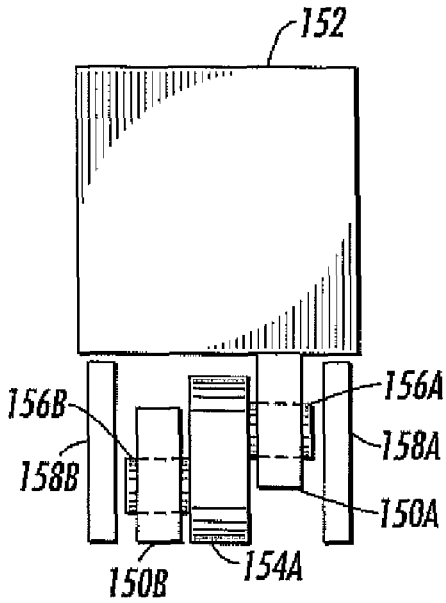
FIG. 6 is an end view of the walking beam shown in FIG. 5.
Figure 7:
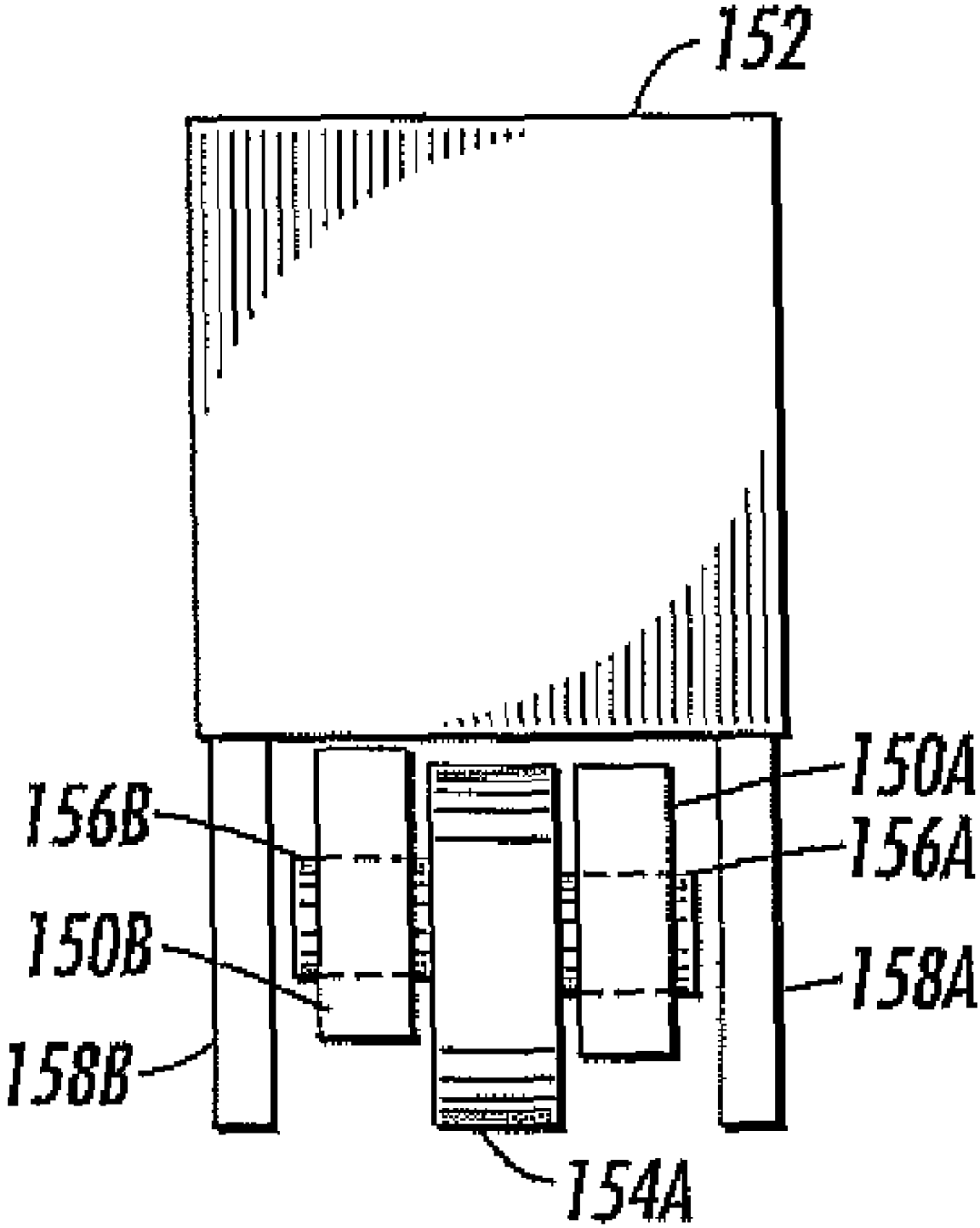
FIG. 7 is the end view of FIG. 6 after the cams coupled to the walking beam of FIG. 5 and FIG. 6 have rotated past the position shown in FIG. 6.

An embodiment that uses a walking beam to move an ink stick 152 along the second transportation path 60 is shown in FIG. 5, FIG. 6, and FIG. 7. The side view provided in FIG. 5 shows a walking beam 150A that is eccentrically mounted to the posts 156A and 162A that extend from the two cams 154A and 166A, respectively. As the cams rotate, the walking beam 150A moves upwardly and forwardly during 180 degrees of the cam's rotation followed by the walking beam moving downwardly and rearward during the next 180 degrees of the cam's rotation. An end view of this embodiment is shown in FIG. 6. In FIG. 6, a pair of walking beams, 150A and 150B, are mounted parallel to one another within a pair of ink stick supports 158A and 158B. As cam 154A rotates, the post 156A rotates and forwardly lifts the beam 150A. The beam 150B mounted on the post 156B, which is positioned on the opposite of cam 154A at a position that is 180 degrees out of phase with the post 156A, moves down and to the rear. Thus, the beam 150A is above the supports 158A and 158B, while the beam 150B is below the support rails 158A and 158B. After the cam rotates past this position, the post 156A begins to move downwardly and the post 156B begins to move upwardly. This continued rotation leads to the reversed relationship of the two beams shown in FIG. 6B. When a beam is moving upwardly past the support rails and forwardly, it urges the ink stick 152 forward towards a melt assembly. When the beam drops below the support rails and rearward, it releases the ink stick so the other beam can act on the ink stick. The action of the two beams 150A and 150B moves the ink stick 152 along the second transportation path to the melt assembly. Alternatives to the walking beam described are possible, including a parallel configuration, where both beams simultaneously lift the ink, move it forward, then set it down on supports, while the reverse direction of the beams occur without contacting the stick so the movement may be repeated.

In another embodiment (not shown), the source of the mechanically generated force that acts on the ink stick may be a vacuum or high speed fan or compressor that generates a pressurized flow of air to move the solid ink along the second or subsequent transportation path. In another embodiment (not shown), the force may be exerted against a push plate by a push rod or biaser, such as a spring, to move the solid ink along a transportation path. In this embodiment, the connection of one transportation path to another transportation path includes a gate, for example, the gate arm 128D shown in FIG. 4, that may be moved to open or block the connection of the two transportation paths. When gravity has loaded solid ink into the mechanized transportation path at the connection between the two transportation paths, the gate closes so the push rod/biaser and push plate combination move the solid ink along the second transportation path to the melting assembly 38. Once the end of travel position is reached, the biaser may be compressed or the push rod retracted to the home position. The gate may then be re-opened to enable the ingress of solid ink into the second transportation path. The cycle may then repeat to provide more solid ink to the melting assembly. The reader should note that more than two transportation paths may be used to deliver solid ink to a melting device. The transportation paths are coupled to one another in series so a preceding transportation path transitions to the next transportation path and the final transportation path terminates in an exit. The forces provided to move solid ink along the transportation paths may include any known mechanically generated, electromechanically generated, or gravitational forces, including any combination of those forces as described above as well as others.

Figure 8:
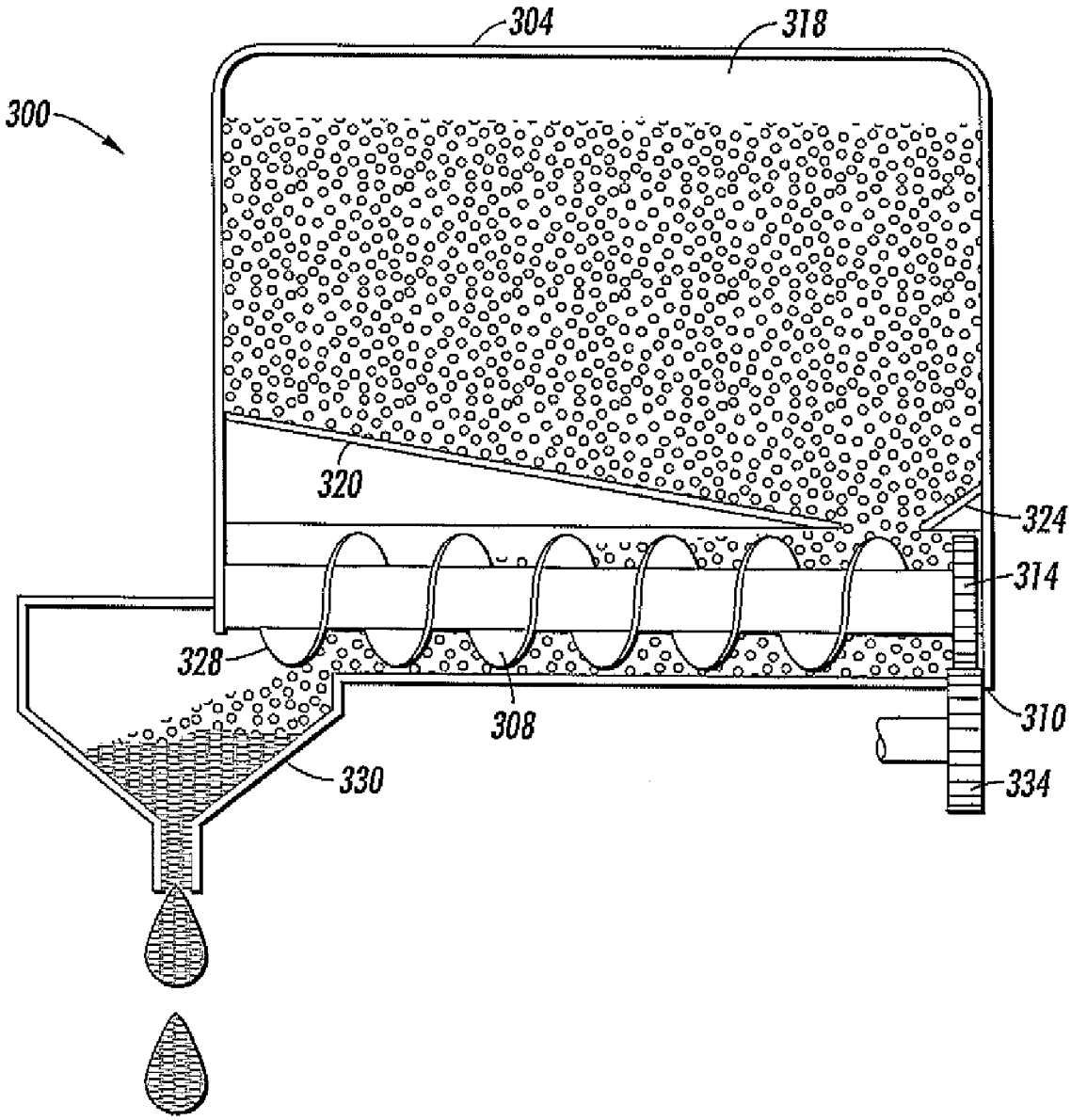
FIG. 8 is a solid ink cartridge that incorporates two types of transportation paths within the cartridge.

Another embodiment of a two path loader is shown in FIG. 8. The loader 300 includes a housing 304 and a leadscrew 308 mounted for rotation within the housing 304. A window 310 exposes a drive sprocket 314 on one end of the lead screw 308. Mounted over the leadscrew 308 is a repository 318 that is filled with granular, powder, small piece, or pastille solid ink form at a manufacturing facility before the housing is closed. Sloped ramps 320 and 324 direct the solid ink towards the leadscrew 308. At the end of the leadscrew 308 that is opposite the end at which the drive sprocket 314 is located, an exit port 328 is located. At the manufacturing site, the window 310 and the port 328 may be closed with a moveable shutter, tape or these structures may be formed in the housing 304 with breakaway coverings.

When installed, the port 328 and the window 310 are opened. The housing 304 is mounted to a printer so the port 328 is proximate a feed path to a melting device, a melt funnel 330, or other melt assembly. The melt funnel 330 is a structure that can be heated to an ink melt temperature and that can direct the melted ink to an ink reservoir or the like. The window 310 enables a drive wheel or gear 334 of the printer to engage the drive sprocket 314. Drive gear 334 is connected to a drive motor (not shown) so the drive wheel can be driven in a direction that turns the drive sprocket 314 so the leadscrew 308 carries solid ink from the terminal ends of the ramps 320 and 324 to the port 328. The solid ink then falls from the port 328 into the melt funnel 330 and is melted for use in the printer. The loader 300 may be mounted internally or externally of a printer. A printer using the loader 300 requires a loader for each color of ink to be used in the printer.

As can be seen from the description presented above, two or more transportation paths may be provided between a loader and a melting assembly to move solid ink from the loader to the melting assembly. Individual transportation paths, as referenced herein, are delineated as having different vectors, different motive forces, or a combination of changed motive forces or vectors. By breaking the feed path into multiple transportation paths, the solid ink path may purposefully transition through a printer or other solid ink device to accommodate the arrangement of the device components and improve the configuration of the printer by placing ink fill points at locations that provide convenient access. Additionally, the feed path may be configured to locate components, such as the melting assembly, in positions better suited for thermal control of the melting or to reduce the length of a tube carrying melted ink. The transportation paths forming the feed path may be oriented so gravity is the primary force for moving solid ink along the transportation path or so gravity merely assists a force generated by an electromechanical force. Multiple segment feed paths enable the length of the overall path to be increased and a longer transportation path enables increased load capacity. Thus, the transport system described above makes the design of solid ink devices simpler, more easily accommodated, and/or more efficient. Additionally, a transportation path does not need to rely solely on one type of force or gravity to move solid ink along the path.

Those skilled in the art will recognize that numerous modifications can be made to the specific implementations described above. Therefore, the following claims are not to be limited to the specific embodiments illustrated and described above. The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

The invention claimed is:

1. A system for transporting solid ink in a solid ink printer comprising:

a housing having an opening through which solid ink is inserted, the opening including a mechanical coupler that mates with an outlet port of a solid ink container and is configured to operate as a gravity feed to move solid ink from within the solid ink container into the opening;

a first transportation path coupled at one end to the housing opening and configured to operate as a gravity feed to move the solid ink from the housing opening along the first transportation path;

at least one other transportation path coupled at one end to the other end of the first transportation path, the solid ink being moved along the at least one other transportation path primarily by a mechanically generated force that is generated by a rotational output of an electrical motor coupled to a helical device; and a melting device coupled to an exit of the at least one other transportation path to receive the solid ink moved along the at least one other transportation path.

2. The system of claim 1, the first transportation path being oriented with respect to the opening to enable the first transportation path to operate as a gravity feed to move the solid ink from the one end of the first transportation path to the other end of the first transportation path.

3. The system of claim 2, the first transportation path being configured to direct pieces of solid ink along the first transportation path towards the other end of the first transportation path.

4. The system of claim 1, the second transportation path being a conveyor that is moved by the mechanically generated force.

5. The system of claim 4, the conveyor being one of an endless belt, at least one roller, and a walking beam.

6. A solid ink transport system comprising:

a housing for holding solid ink;

a first transportation path within the housing that operates as a gravity feed to direct solid ink downwardly within the housing; and a second transportation path within the housing that receives solid ink from the first transportation path at one end and that moves the solid ink towards an exit port in the housing primarily by a conveyor configured as a helical device that is coupled at one end to an electrical motor to enable the conveyor to move and transport solid ink on the conveyor towards the exit port.

7. The solid ink transport system of claim 6, the first transportation path including:

at least one inclined plane that directs the solid ink towards the second transportation path.

8. A solid ink transport system comprising:

a housing having an opening through which solid ink is inserted, the opening including a mechanical coupler configured to mate with an outlet port of a solid ink container and operate as a gravity feed to move solid ink from the solid ink container to the opening in the housing;

a first transportation path coupled at one end to the opening and configured to operate as a gravity feed to move the solid ink from the opening along the first transportation path;

at least one other transportation path coupled at one end to another end of the first transportation path, the at least one other transportation path having a conveyor that is coupled at one end to an electrical motor to move the conveyor and transport solid ink along the one other transportation path towards an exit; and a melting device coupled to the exit to receive the solid ink moved by the conveyor along the at least one other transportation path, the melting device including at least one seal through which the conveyor urges the solid ink for melting within the melting device.

9. The solid ink transport system of claim 8, the first transportation path being configured as a conduit to direct solid ink pieces towards the at least one other transportation path.

10. The solid ink transport of claim 8, the at least one other transportation path being coupled between a transportation path subsequent to the first transportation path and the exit.

11. The solid ink transport system of claim 8, the conveyor being one of an endless belt, at least one roller, and a walking beam.

12. A solid ink transport system comprising:

a housing having an opening through which solid ink is inserted;

a first transport path located proximate an exterior of the housing, the first transportation path being coupled at one end to the opening and configured to operate as a gravity feed to move the solid ink from the opening along the first transportation path;

at least one other transportation path being oriented to extend away from the exterior of the housing and being coupled at one end to another end of the first transportation path, the at least one other transportation path having a conveyor that is coupled at one end to an electrical motor to move the conveyor and transport solid ink along the one other transportation path towards an exit; and a melting device coupled to the exit to receive the solid ink moved by the conveyor along the second transportation path, the melting device being located within an interior space of the housing.

13. A solid ink transport system comprising:

a housing having an opening through which solid ink is inserted, the opening including a mechanical coupler configured to mate with an outlet port of a solid ink container and operate as a gravity feed to move solid ink from the solid ink container to the opening in the housing;

a first transportation path coupled at one end to the opening and configured to operate as a gravity feed to move the solid ink from the opening along the first transportation path;

at least one other transportation path coupled between a transportation path subsequent to the first transportation path and an exit, the at least one other transportation path having a conveyor that is coupled at one end to an electrical motor to move the conveyor and transport solid ink along the at least one other transportation path towards the exit subsequent to the first transportation path and the transportation path subsequent to the first transportation path being configured as a gravity feed to move the solid ink towards the at least one other transportation path; and a melting device coupled to the exit to receive the solid ink moved by the conveyor along the second transportation path.

14. A solid ink transport system comprising:

a housing having an opening through which solid ink is inserted, the opening including a mechanical coupler configured to mate with an outlet port of a solid ink container and operate as a gravity feed to move solid ink from the solid ink container to the opening in the housing;

a first transportation path coupled at one end to the opening and configured to operate as a gravity feed to move the solid ink from the opening along the first transportation path;

at least one other transportation path coupled at one end to another end of the first transportation path, the at least one other transportation path having a conveyor that is coupled at one end to an electrical motor to move the conveyor and transport solid ink along the one other transportation path towards an exit, the at least one other transportation path having at least a partially vertical drop to assist movement of the solid ink towards the exit; and a melting device coupled to the exit to receive the solid ink moved by the conveyor along the second transportation path.

* * * * *